US011107417B1

(12) United States Patent
Kim et al.

(10) Patent No.: US 11,107,417 B1
(45) Date of Patent: Aug. 31, 2021

(54) DISPLAY PANEL DRIVING DEVICE, DISPLAY DEVICE, AND DRIVING METHOD THEREOF

(71) Applicant: SAMSUNG DISPLAY CO., LTD., Yongin-si (KR)

(72) Inventors: Jung Taek Kim, Yongin-si (KR); Kyun Ho Kim, Yongin-si (KR); Jae Woo Ryu, Yongin-si (KR); Hyung Keun Park, Yongin-si (KR); Joon Suk Baik, Yongin-si (KR); Sang Su Han, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/031,244

(22) Filed: Sep. 24, 2020

(30) Foreign Application Priority Data

Feb. 21, 2020 (KR) ..... 10-2020-0021720

(51) Int. Cl.

| | |
|---|---|
| ***G09G 5/00*** | (2006.01) |
| ***G09G 3/3275*** | (2016.01) |
| *G09G 3/3233* | (2016.01) |
| *G09G 3/3266* | (2016.01) |

(52) U.S. Cl.
CPC ..... *G09G 3/3275* (2013.01); *G09G 5/008* (2013.01); *G09G 3/3233* (2013.01); *G09G 3/3266* (2013.01); *G09G 2300/08* (2013.01); *G09G 2310/0291* (2013.01); *G09G 2310/08* (2013.01)

(58) Field of Classification Search
CPC ..... G06F 3/0412; G06F 3/04164; G06F 3/04166; G06F 3/044; G06F 3/0443; G09G 2310/08; G09G 2320/0223; G09G 2354/00; G09G 3/3611; G09G 3/3666; G09G 3/3677; G09G 3/3688
See application file for complete search history.

(56) References Cited

U.S. PATENT DOCUMENTS

| | | | |
|---|---|---|---|
| 8,797,311 | B2 | 8/2014 | Kim |
| 10,001,886 | B2 | 6/2018 | Han et al. |

FOREIGN PATENT DOCUMENTS

| | | | |
|---|---|---|---|
| KR | 1020110024099 | A | 3/2011 |
| KR | 1020150044318 | A | 4/2015 |
| KR | 101891710 | B1 | 9/2018 |
| KR | 1020190048887 | A | 5/2019 |

*Primary Examiner* — Insa Sadio
(74) *Attorney, Agent, or Firm* — Cantor Colburn LLP

(57) ABSTRACT

A display device includes a display panel. The display panel includes a display panel including a data line, a sensing line, and pixels coupled to the data line and the sensing line. A timing controller generates clock embedded data including image data and a clock training signal. A data driver recovers a clock signal, based on the clock training signal of the clock embedded data, recovers the image data of the clock embedded data, based on the clock signal, supplies a data voltage corresponding to the image data to the data line in a first section, and receives a sensing signal from a pixel of the pixels through the sensing line in a second section different from the first section. In the second section, the data driver recovers the clock signal while the sensing signal is being received.

20 Claims, 12 Drawing Sheets

DISPLAY PANEL DRIVING DEVICE, DISPLAY DEVICE, AND DRIVING METHOD THEREOF

This application claims priority to Korean patent application 10-2020-0021720, filed on Feb. 21, 2020, and all the benefits accruing therefrom under 35 U.S.C. § 119, the content of which in its entirety is herein incorporated by reference.

BACKGROUND

1. Field

The disclosure generally relates to a display panel driving device, a display device, and a driving method thereof.

2. Related Art

A display device typically includes pixels, and each of the pixels may include a light emitting element and a driving transistor which supplies a driving current to the light emitting element. In such a display device, each of the pixels may be degraded. For example, the threshold voltage and mobility of the driving transistor may be changed over time. In such a display device, the light emitting element may be degraded. Accordingly, a technique for sensing characteristic information of the pixels (i.e., the driving transistor and the light emitting element) may be used to compensate for degradation of the pixels.

The display device may transmit various data used for generation of a data signal through an intra-panel interface built between a timing controller ("T-CON") and a source driver ("S-IC"). The display device may use clock embedded data, in which a clock is embedded in data, to decrease the number of lines of the intra-panel interface.

In such a display device, a clock training signal (or clock training pattern) used for clock recovery may be provided from the timing controller to the data driver to stably recover a clock and data in a data driver.

SUMMARY

In a display device, during a display section of a frame period in which an image is displayed, one horizontal time (i.e., a time for which data is provided to one pixel row) may be about 1.84 microseconds (μs), and therefore, the timing controller may provide the clock training signal to the data driver in a unit of a frame (e.g., at an interval of 1/60 second).

However, during a sensing section of the frame period in which a characteristic of the pixel is sensed, one sensing horizontal time (i.e., a time for which the characteristic of the pixel in one pixel row is sensed) may be about 635 μs. When the clock training signal is provided in a unit of a frame (e.g., an interval of about three seconds), a clock of the data driver may be different from that of the timing controller, and an error may occur in the recovery of the clock and data.

In addition, when a time for transmitting the clock training signal is additionally allocated to the one sensing horizontal time, sensing time may be lengthened.

Embodiments provide a display panel driving device, a display device, and a driving method thereof, which can stably recover a clock and data while preventing an increase in sensing time.

In accordance with an embodiment of the disclosure, a display device includes: a display panel including a data line, a sensing line, and pixels coupled to the data line and the sensing line; a timing controller which generates clock embedded data including image data and a clock training to signal; and a data driver which recovers a clock signal, based on the clock training signal of the clock embedded data, recovers the image data of the clock embedded data, based on the clock signal, supplies a data voltage corresponding to the image data to the data line in a first section, and receives a sensing signal from a pixel of the pixels through the sensing line in a second section different from the first section. In such an embodiment, in the second section, the data driver recovers the clock signal while the sensing signal is being received.

In an embodiment, in the second section, the data driver may sequentially receive sensing signals from the pixels, and recover the clock signal whenever each of the sensing signals is received.

In an embodiment, the data driver may sense each of the sensing signals of the pixels with a first period, and repeatedly recover the clock signal with the first period.

In an embodiment, the second section may include a first sub-section, a second sub-section, and a third sub-section. In such an embodiment, the data driver may sample a sensing signal of the pixel of the pixels in the first sub-section, convert the sampled sensing signal from an analog form to a digital form in the second sub-section, and transmit the sensing signal in the digital form to the timing controller in the third sub-section. In such an embodiment, the data driver may recover the clock signal in one of the first to third sub-sections.

In an embodiment, the data driver may recover the clock signal in the first sub-section.

In an embodiment, the data driver may not recover the clock signal in the second sub-section.

In an embodiment, in the second section, the clock embedded data may sequentially include a first control signal for controlling start of a sensing operation of the data driver and a second signal for controlling output of the sensing signal of the data driver. In such an embodiment, the clock embedded data may include the clock training signal between the first control signal and the second control signal.

In an embodiment, the data driver may include: a sampling switch including one end coupled to the sensing line; a capacitor coupled between the other end of the sampling switch and a reference power source to sample the sensing signal; and an analog-digital converter coupled to the other end of the sampling switch. In such an embodiment, the data driver may recover the clock signal while the sampling switch is being turned on.

In an embodiment, the data driver may perform one-time clock training for every section in which the sampling switch is turned on.

In an embodiment, the data driver may provide a reference voltage to the data line in the first to third sub-sections.

In an embodiment, the data driver may provide a black data voltage at which the pixel does not emit light in the third sub-section.

In an embodiment, the data driver may recover the clock signal in the third sub-section.

In an embodiment, the display panel may further include a scan line, a sensing control line, a first power line, and a second power line. In such an embodiment, each of the pixels may include: a first transistor including a first electrode coupled to the first power line, a second electrode coupled to a second node, and a gate electrode coupled to a first node; a second transistor including a first electrode coupled to the data line, a second electrode coupled to the first node, and a gate electrode coupled to the scan line; a third transistor including a first electrode coupled to the second node, a second electrode coupled to the sensing line, and a gate electrode coupled to the sensing control line; a storage capacitor coupled between the first node and the second node; and a light emitting element coupled between the second node and the second power line. In such an embodiment, the data driver may recover the clock signal while the second transistor of each of the pixels is being turned on.

In an embodiment, in the first section, the data driver may recover the clock signal before or after a portion of clock embedded data corresponding to image data of one frame is received.

In an embodiment, the timing controller may provide a recovery timing control signal to the data driver, and the data driver may recover the clock signal in response to the recovery timing control signal.

In accordance with another embodiment of the disclosure, a display panel driving device for driving a display panel including a data line, a sensing line, and pixels coupled to the data line and the sensing line, includes: a timing controller which generates clock embedded data including image data and a clock training signal; and a data driver which recovers a clock signal, based on the clock training signal of the clock embedded data, recovers the image data of the clock embedded data, based on the clock signal, supplies a data voltage corresponding to the image data to the data line in a first section, and receives a sensing signal from a pixel of the pixels through the sensing line in a second section different from the first section. In such an embodiment, in the second section, the data driver recovers the clock signal while the sensing signal is being received.

In accordance with another embodiment of the disclosure, method of driving a display device including a display panel including a data line, a sensing line, and pixels coupled to the data line and the sensing line, includes: generating, by a timing controller of the display device, clock embedded data including image data and a clock training signal; recovering, by a data driver of the display device, a clock signal, based on the clock training signal of the clock embedded data; recovering, by the data driver, the image data of the clock embedded data, based on the clock signal; supplying, by the data driver, a data voltage corresponding to the image data to the data line in a first section; and receiving, by the data driver, a sensing signal from a pixel of the pixels through the sensing line in a second section different from the first section. In such an embodiment, the receiving the sensing signal includes recovering, by the data driver, the clock signal while the sensing signal is being received.

In an embodiment, in the second section, the data driver may sequentially receive sensing signals from the pixels, and recover the clock signal whenever each of the sensing signals is received.

In an embodiment, the second section may include a first sub-section, a second sub-section, and a third sub-section. In such an embodiment, the receiving the sensing signal may further include: sampling a sensing signal of one of the pixels in the first sub-section; converting the sampled sensing signal from an analog form to a digital form in the second sub-section; and transmitting the sensing signal in the digital form to the timing controller from the data driver in the third sub-section. In such an embodiment, the data driver may recover the clock signal in one of the first to third sub-sections.

In an embodiment, the data driver may recover the clock signal in the first sub-section.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
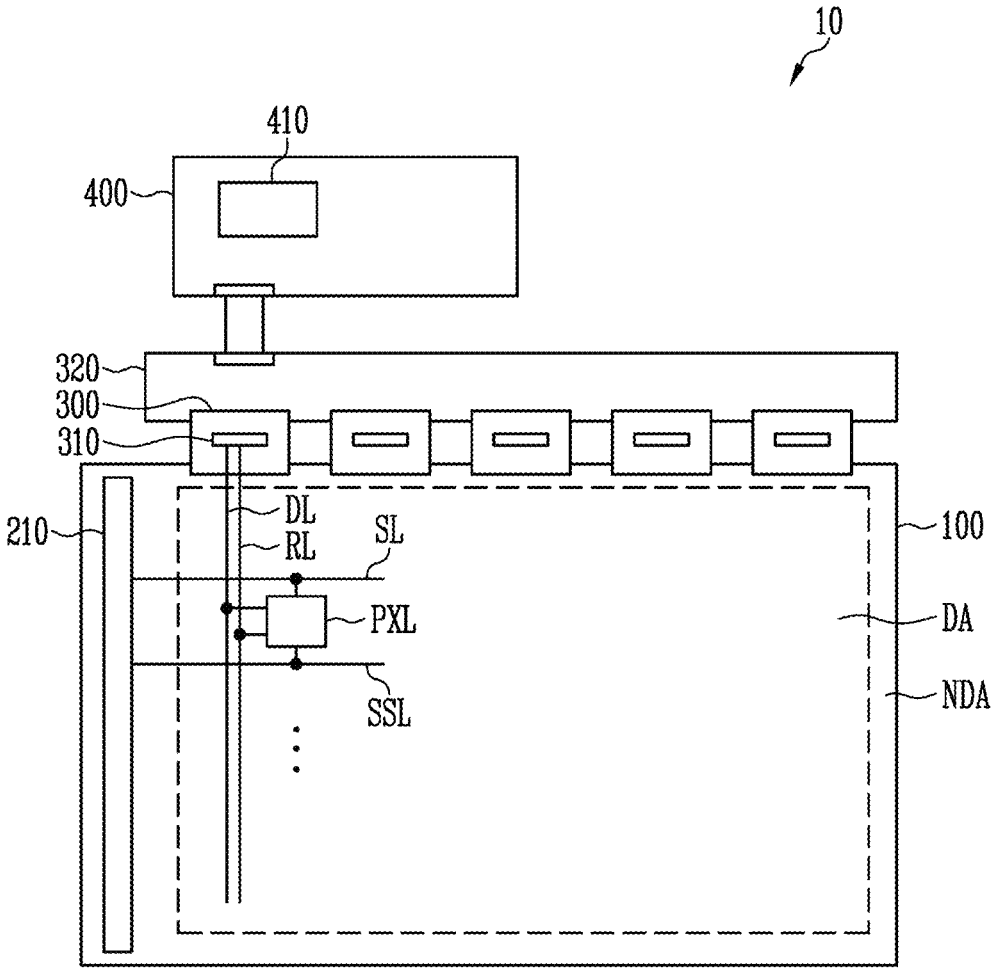
FIG. 1 is a diagram illustrating a display device in accordance with an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region,"

"layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated to features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

FIG. 1 is a diagram illustrating a display device in accordance with an embodiment of the disclosure. In an embodiment, a display device may include a plurality of data drivers (or source drive integrated circuits ("IC"s)) as illustrated in FIG. 1. However, the disclosure is not limited thereto. In one alternative embodiment, for example, a display device may have a single data to driver (or a single source drive IC). In addition, the disclosure is not limited particularly to an organic light emitting display device, and may be applied to other types of display device such as a liquid crystal display device.

Referring to FIG. 1, an embodiment of the display device 10 may include a display panel 100, a scan driver 210 (or gate driver, or gate drive IC), a data driver 310 (or source driver, or source drive IC), and a timing controller 410. The scan driver 210, the data driver 310, and the timing controller 410 may constitute or collectively define a display panel driving device which drives the display panel 100.

The display panel 100 may include a display area DA in which an image is displayed and a non-display area NDA at the periphery of the display area DA. The display panel 100 may include a scan line SL, a sensing control line SSL, a data line DL, a sensing line RL (or readout line), and a pixel PXL.

The pixel PXL may be located in an area defined by the scan line SL, the sensing control line SSL, the data line DL, and the sensing line RL. The display panel 100 may include a plurality of pixels. In one embodiment, for example, each of the pixels may be coupled (or connected) to a single data line DL and a single sensing line RL. A detailed configuration of the pixel PXL will be described later with reference to FIG. 2.

In an embodiment, the timing controller 410 may control the scan driver 210 and the data driver 310. The timing controller 410 may receive a control signal (e.g., a control signal including a clock signal) from an outside, and generate a scan control signal (or gate control signal) and a data control signal, based on the control signal. The timing controller 410 may provide the scan control signal to the scan driver 210, and provide the data control signal to the data driver 310.

In such an embodiment, the timing controller 410 may generate frame data (or image data) by realigning input data (or original image data) provided from the outside (e.g., a graphic processor), and generate clock embedded data by inserting a clock training signal (or clock training pattern) into the frame data. The clock training signal may be used to recover a clock signal in the data driver 310. In one embodiment, for example, the clock training signal may include a value corresponding to a square wave, similarly to the clock signal. In one embodiment, for example, the timing controller 410 may insert the clock training signal between the frame data and adjacent frame data.

The timing controller 410 may provide the clock embedded data to the data driver 310. The timing controller 410 may transmit the clock embedded data in a packet form to the data driver 310 by using a serial interface (or high-speed serial interface). The timing controller 410 may be disposed or mounted on a control board 400.

The scan driver 210 and the data driver 310 may drive the display panel 100.

The scan driver 210 may receive the scan control signal from the timing controller 410, and generate a scan signal and a sensing control signal (or sensing scan signal), based on the scan control signal. The scan driver 210 may provide a scan signal to the scan line SL, and a sensing control signal to the sensing control line SSL.

The scan driver 210 may be provided or formed together with the pixel PXL on the display panel 100. However, the disclosure is not limited thereto. In one embodiment, for example, the scan driver 210 may be disposed or mounted on a separate circuit film, and be coupled to the timing controller 410 mounted on the control board 400 via a circuit film 300 and a printed circuit board 320.

The data driver 310 may receive the data control signal and the clock embedded data from the timing controller 410, recover a clock signal, based on the clock training signal of the clock embedded data, and recover frame data from the clock embedded data, based on the clock signal. Also, in a first section (or a first period, e.g., a display section, in a frame period in which an image is displayed on the display panel 100), the data driver 310 may generate a data signal corresponding to the frame data, and provide the data signal to the data line DL.

In a second section (or a second period, e.g., a sensing section of a frame period for sensing characteristic information of the pixel PXL such as a threshold voltage and/or a mobility of a driving transistor included in the pixel PXL) different from the first section, the data driver 310 may receive a sensing signal from a pixel PXL among the pixels through the sensing line RL.

In one embodiment, for example, the second section may be a vertical blank section (or vertical porch section) between the first section and an adjacent first section (e.g., another frame section), and the data driver 310 may receive a sensing signal (e.g., a mobility of the driving transistor or a signal related thereto) from the pixel PXL. In an alternative embodiment, the second section may be a section immediately before the display device 10 is power-off, and the data driver 310 may sequentially receive, in a unit of a pixel row, sensing signals (e.g., a threshold voltage of the driving transistor of each of pixels including the pixel PXL) from the pixels.

In an embodiment, in the second section, the data driver 310 may recover a clock signal, while a sensing signal is being received from a pixel PXL. In such an embodiment, in the second section, the data driver 310 may perform a clock training operation of recovering the clock signal, while receiving the sensing signal.

In an embodiment, in the second section, the data driver 310 may sequentially receive sensing signals from the pixels, and recover the clock signal whenever the data driver 310 receives each of the sensing signals. In one embodiment, for example, in the second section, the data driver 310 may sense each of the sensing signals of the pixels repeatedly with a first period (e.g., about 635 microseconds (μs)), and repeatedly recover the clock signal with the first period.

A detailed operation of recovering the clock signal of the data driver 310 will be described later with reference to FIG. 6.

The data driver 310 may be disposed or mounted on the circuit film 300, and be coupled to the timing controller 410 via a printed circuit board 320 and/or a cable.

In an embodiment, as described above, the display device 10 (or the data driver 310) may recover the clock signal while the sensing signal is being received from the pixel PXL. Thus, since a separate time for recovering the clock signal is not allocated to the second section, an increase in the second section, i.e., the sensing section, may be effectively prevented. In such an embodiment, the display device 10 may recover the clock signal in the unit of the pixel row. Thus, synchronization between the timing controller 410 and the data driver 310 may be effectively maintained.

Figure 2:
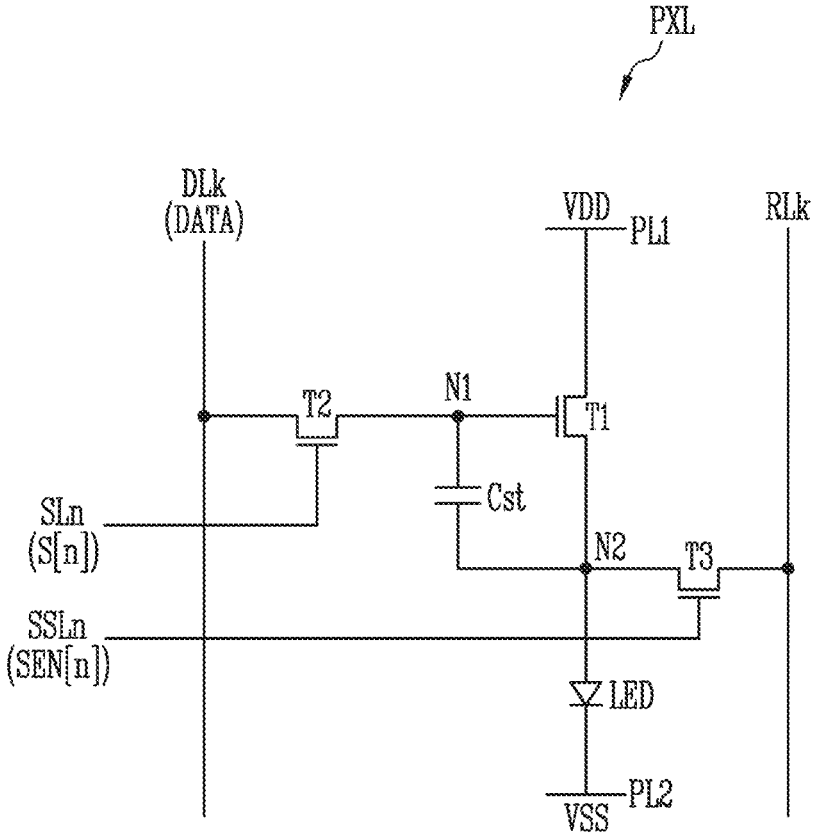
FIG. 2 is a circuit diagram illustrating an embodiment of a pixel included in the display device shown in FIG. 1.

FIG. 2 is a circuit diagram illustrating an embodiment of the pixel included in the display device shown in FIG. 1. A pixel PXL included in an n-th pixel row and a k-th pixel column is exemplarily illustrated in FIG. 2 (n and k are positive integers).

Referring to FIG. 2, an embodiment of the pixel PXL may be coupled to an n-th scan line SLn, a k-th data line DLk, an n-th sensing control line SSLn, and a k-th sensing line RLk.

The pixel PXL may include a light emitting element LED, a first transistor T1 (driving transistor), a second transistor T2 (switching transistor), a third transistor T3 (sensing transistor), and a storage capacitor Cst. Each of the first transistor T1, the second transistor T2, and the third transistor T3 may be a thin film transistor including an oxide semiconductor.

An anode electrode of the light emitting element LED may be coupled to a second node N2 (or a second electrode of the first transistor T1), and a cathode electrode of the light emitting element LED may be coupled to a second power line PL2 to which a second power voltage VSS is applied. The light emitting element LED may emit light with a predetermined luminance corresponding to an amount of current (or driving current) supplied thereto from the first transistor T1. In an embodiment, the light emitting element LED may be an organic light emitting diode. However, the disclosure is not limited thereto, and alternatively, the light emitting element LED may include an inorganic light emitting diode.

A first electrode of the first transistor T1 may be coupled to a first power line PL1 to which a first power voltage VDD is applied, and the second electrode of the first transistor T1 may be coupled to the second node N2 (or the anode electrode of the light emitting element LED). A gate electrode of the first transistor T1 may be coupled to a first node N1. The first transistor T1 controls an amount of current flowing through the light emitting element LED, based on a voltage of the first node N1.

A first electrode of the second transistor T2 may be coupled to the k-th data line DLk, and a second electrode of the second transistor T2 may be coupled to the first node N1. A gate electrode of the second transistor T2 may be coupled to the n-th scan line SLn. The second transistor T2 may be turned on when a scan signal S[n] is supplied to the n-th scan line SLn, to transfer a data voltage DATA (or data signal) from the k-th data line DLk to the first node N1.

The storage capacitor Cst may be coupled between the first node N1 and the anode electrode of the light emitting element LED. The storage capacitor Cst may store the voltage of the first node N1.

The third transistor T3 may be coupled between the k-th sensing line RLk and the second node N2 (or the second electrode of the first transistor T1). The third transistor T3 may couple the second node N2 and the k-th sensing line RLk to each other in response to a sensing control signal SEN[n]. A sensing signal may be provided to the k-th sensing line RLk. In one embodiment, for example, a sensing voltage (or a node voltage of the second node N2) may be provided to the k-th sensing line RLk. However, the disclosure is not limited thereto, and alternatively, a sensing current corresponding to the node voltage of the second node N2 may be transferred to the k-th sensing line RLk. The sensing voltage may be provided to the data driver 310 (see FIG. 1) through the k-th sensing line RLk.

However, the embodiment of the pixel PXL shown in FIG. 2 is merely exemplary, and embodiments of the pixel PXL are not limited thereto.

Figure 3:
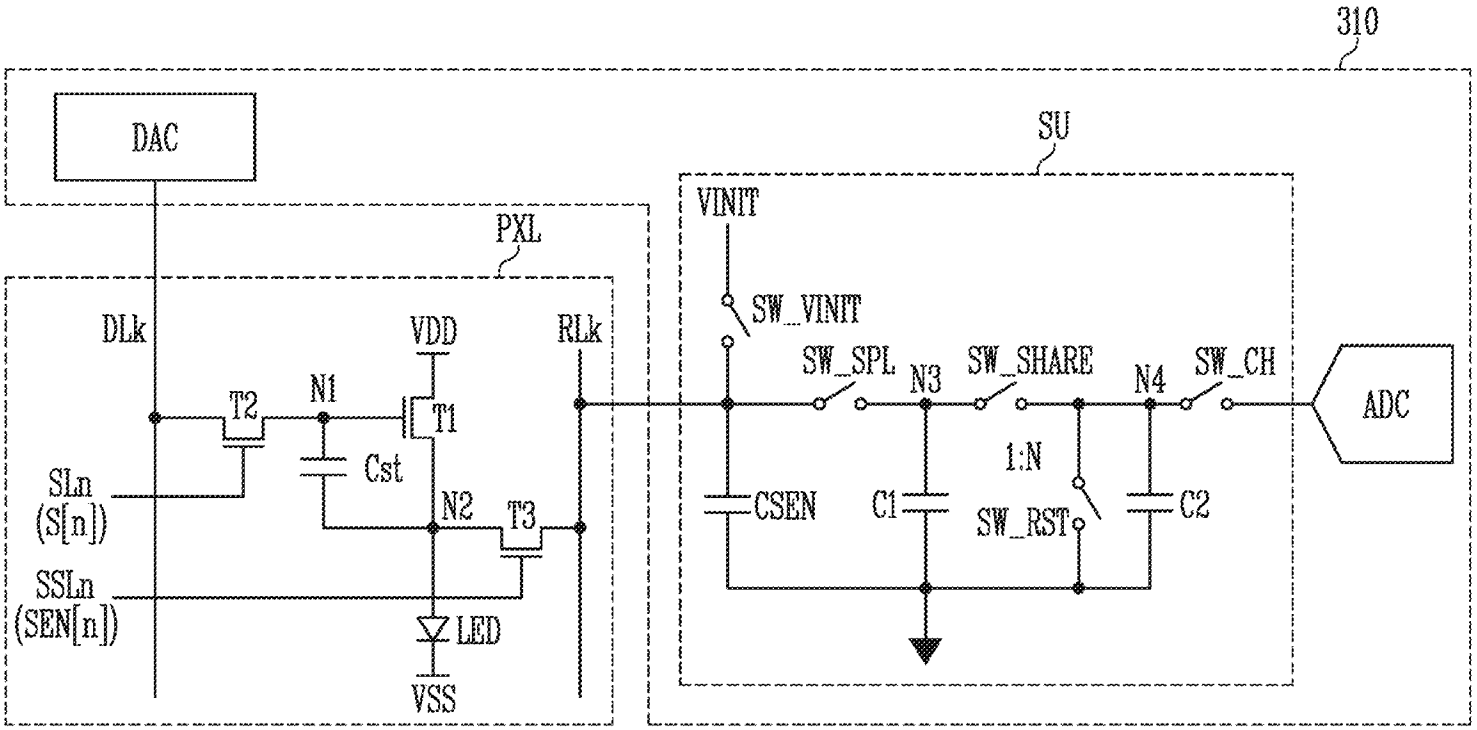
FIG. 3 is a circuit diagram illustrating an embodiment of a data driver included in the display device shown in FIG. 1.

FIG. 3 is a circuit diagram illustrating an embodiment of the data driver included in the display device shown in FIG. 1. The data driver 310 is briefly illustrated in FIG. 3, based on a portion of the data driver 310 coupled to a pixel PXL through a k-th sensing line RLk, to sense a characteristic of the pixel PXL.

Referring to FIGS. 1, 2, and 3, the pixel PXL shown in FIG. 3 is substantially to the same as the pixel PXL described with reference to FIG. 2, and any repetitive detailed description thereof will be omitted.

The data driver 310 may include a digital-analog converter DAC. The digital-analog converter DAC may generate a data voltage corresponding to a data value (or grayscale data) included in frame data (or image data). In one embodiment, for example, the digital-analog converter DAC may select one of gamma voltages, based on the data value, and output the selected gamma voltage as a data voltage (or data signal).

In an embodiment, although not shown in the drawing, the data driver 310 may further include an output buffer, and provide a data voltage to a k-th data line DLk through the output buffer.

The data driver 310 may further include a sensing unit SU and an analog-digital converter ADC, which are coupled to the k-th sensing line RLk.

The sensing unit SU may include a sensing capacitor CSEN, a first capacitor C1, a second capacitor C2, an initialization switch SW_VINIT (or first switch), a sampling switch SW_SPL (or second switch), a sharing switch SW_SHARE (or third switch), a reset switch SW_RST (or fourth switch), and an output switch SW_CH (or fifth switch).

The initialization switch SW_VINIT may be coupled between a power line, to which an initialization voltage VINIT is applied, and the k-th sensing line RLk. The initialization voltage VINIT may be provided from a separate power supply, and have a voltage level lower than that of an operating point of a light emitting element LED. When the initialization switch SW_VINIT is turned on, the initialization voltage VINIT may be applied to the kth sensing line RLk. When a third transistor T3 is turned on, the initialization voltage VINIT may be applied to a second node N2 of the pixel PXL. Since the initialization voltage VINIT has a voltage level lower than that of the operating point of the light emitting element LED, the light emitting element LED may not emit light even when a first transistor T1 is turned on.

The sensing capacitor CSEN may be coupled between the k-th sensing line RLk and a reference power source. The reference power source may have a ground voltage, but the disclosure is not limited thereto. When the initialization switch SW_VINIT is turned off and the third transistor T3 of the pixel PXL is turned on, the sensing capacitor CSEN may be charged by a current provided through the second node N2. That is, characteristic information of the pixel PXL, which is provided through the second node N2, may be stored in the sensing capacitor CSEN.

The sampling switch SW_SPL may be coupled between the k-th sensing line RLk and a third node N3. The first capacitor C1 may be coupled between the third node N3 and the reference power source. While the sampling switch SW_SPL is being turned on, the first capacitor C1 may sample the characteristic information of the pixel PXL (or the first transistor T1), which is stored in the sensing capacitor CSEN. That is, the data driver 310 may sample a sensing signal through the sampling switch SW_SPL and the first capacitor C1.

The sharing switch SW_SHARE may be coupled between the third node N3 and a fourth node N4, the reset switch SW_RST may be coupled between the fourth node N4 and the reference power source, and the second capacitor C2 may be coupled to the fourth node and the reference power source. When the sharing switch SW_SHARE is turned on, and the first capacitor C1 and the second capacitor C2 share charges, a node voltage of the fourth node N4 (and a node voltage of the third node N3) may be changed. The sharing switch SW_SHARE, the reset switch SW_RST, and the second capacitor C2 may serve as a buffer based on an operation of the sharing switch SW_SHARE and the reset switch SW_RST. A gain of the buffer is changed depending on a capacitance ratio of the first capacitor C1 and the second capacitor C2, the gain of the buffer may be N (N is an integer greater than 1). That is, the sharing switch SW_SHARE, the reset switch SW_RST, and the second capacitor C2 may amplify the node voltage of the third node N3.

The output switch SW_CH may be coupled between the fourth node N4 and the analog-digital converter ADC, and couple the fourth node N4 to an input terminal of the analog-digital converter ADC. The node voltage of the fourth node N4 may be applied to the analog-digital converter ADC.

Although not shown in the drawing, the data driver 310 may further include a capacitor coupled between the input terminal of the analog-digital converter ADC and the reference power source to maintain the node voltage of the fourth node N4, which is provided to the analog-digital converter ADC and an initialization circuit (e.g., a capacitor initialization power source and a switch for coupling the capacitor initialization power source to the input terminal of the analog-digital converter ADC) which initializes the input terminal of the analog-digital converter ADC (or the capacitor).

The analog-digital converter ADC may convert a voltage provided to the input terminal thereof into a data value (e.g., a digital code). That is, the data driver 310 may convert a sensing signal sampled through the analog-digital converter ADC from an analog form to a digital form. The sensing signal in the digital form (e.g., a digital code) may be provided to the timing controller 410.

An embodiment where the sensing unit SU includes the capacitors CSEN, C1, and C2 and the switches SW_VINIT, SW_SPL, SW_SHARE, SW_RST, and SW_CH is illustrated in FIG. 3, but this is merely exemplary, and the disclosure is not limited thereto. In one alternative embodiment, for example, various circuits (e.g., a sensing circuit which converts a sensing current into a sensing voltage by using an amplifier and samples and holds the converted sensing voltage) may be applied as the sensing unit SU as long as the sensing unit SU detects the node voltage (or a current corresponding thereto) of the second node of the pixel PXL.

Figure 4:
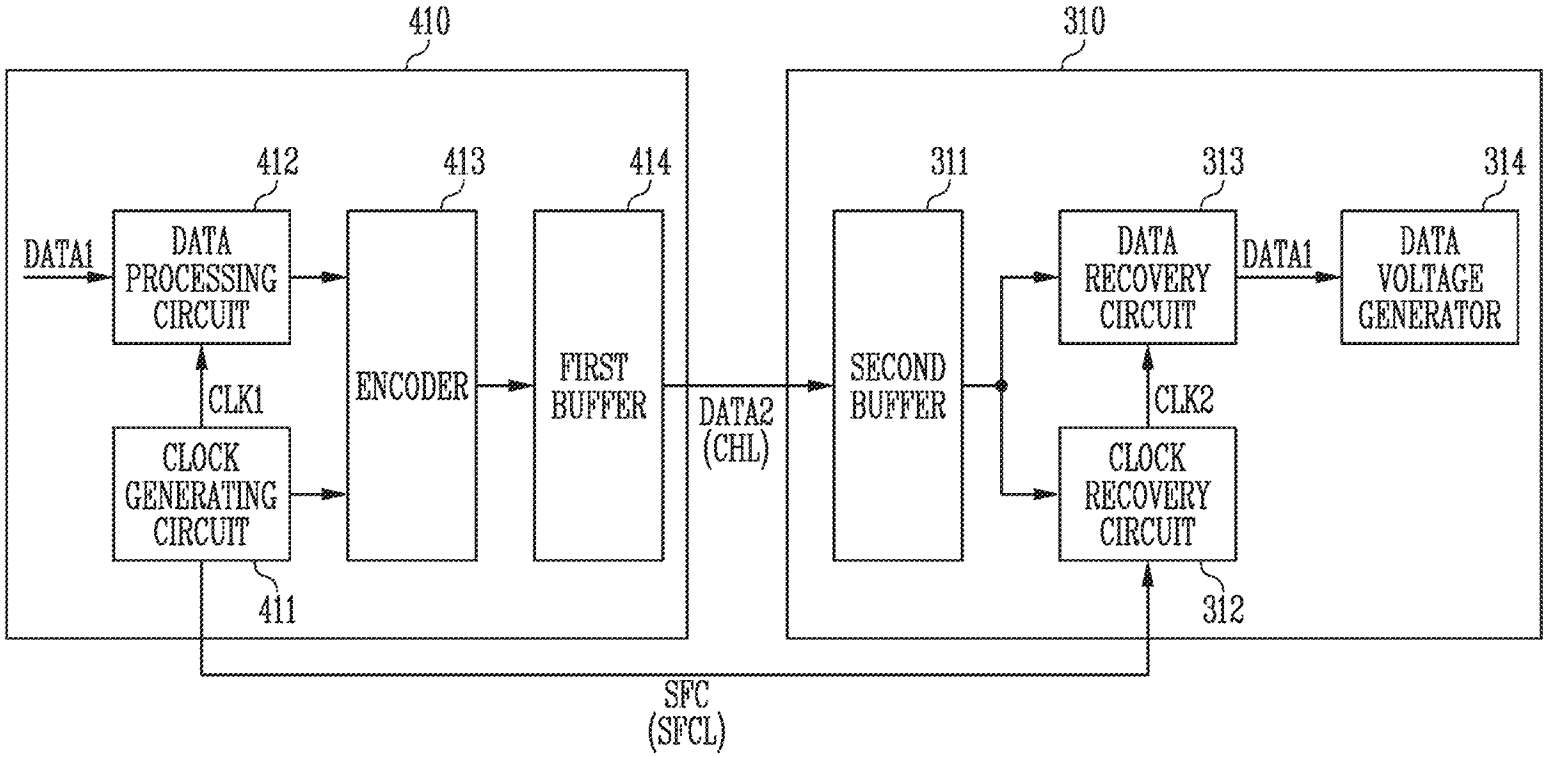
FIG. 4 is a block diagram illustrating an embodiment of a timing to controller and the data driver, which are included in the display device shown in FIG. 1.

FIG. 4 is a block diagram illustrating an embodiment of the timing controller and the data driver, which are included in the display device shown in FIG. 1.

Referring to FIG. 4, an embodiment of the timing controller 410 may include a clock generating circuit 411, a data processing circuit 412 (or data alignment circuit), an encoder 413, and a first buffer 414 (or output buffer).

The clock generating circuit 411 may generate a first clock signal CLK1, based on an external timing signal provided from an outside (e.g., a graphic processor). Also, the clock generating circuit 411 may generate a clock training signal (or clock training pattern) corresponding to the first clock signal CLK1.

In an embodiment, the clock generating circuit 411 may generate a recovery timing control signal SFC (or start frame control signal), and provide the recovery timing control signal SFC to the data driver 310 through a recovery timing control line SFCL. The recovery timing control line SFCL may be configured separately from a channel line CHL. The recovery timing control signal SFC may be a signal for controlling a recovery timing at which a clock signal is recovered in the data driver 310.

The data processing circuit 412 may generate frame data (or image data) by realigning input data DATA1 (or original image data) provided from the outside.

The encoder 413 may generate a data packet DATA2 (or clock embedded data) in a format determined in an intra-panel interface built between the timing controller 410 and the data driver 310. The encoder 413 may embed the clock training signal into the data packet DATA2.

The first buffer 414 may transmit the data packet DATA2 to the data driver 310 through the channel line CHL.

The data driver 310 may include a second buffer 311, a clock recovery circuit 312, a data recovery circuit 313, and a data voltage generator 314.

The second buffer 311 may receive a data packet DATA2 from the timing controller 410, and transfer the data packet DATA2 to the clock recovery circuit 312 and the data recovery circuit 313. In one embodiment, for example, the second buffer 311 may realign, in parallel, the data packet DATA2 serially transmitted from the timing controller 410 through one channel line CHL (or a pair of signal transmission lines), and output the realigned data packet DATA2.

The clock recovery circuit 312 may recover a clock signal, based on the clock training signal in the data packet DATA2. In one embodiment, for example, the clock recovery circuit 312 may generate a second clock signal CLK2, based on the clock training signal.

In an embodiment, the clock recovery circuit 312 may recover a clock signal in response to the recovery timing control signal SFC. In one embodiment, for example, when the recovery timing control signal SFC has a logic low level, the clock recovery circuit 312 may recover the second clock signal CLK2 from the data packet DATA2. In such an embodiment, when the recovery timing control signal SFC has a logic high level, the clock recovery circuit 312 may recover the second clock signal CLK2 from the data packet DATA2.

The data recovery circuit 313 may recover frame data in the data packet DATA2, based on the second clock signal CLK2. In one embodiment, for example, the data recovery circuit 313 may sample each of bits of the frame data in the data packet DATA2, based on the second clock signal CLK2.

The data voltage generator 314 may generate a data voltage (or data signal), based on the recovered frame data. In one embodiment, for example, the data voltage generator 314 may include a shift register, a data latch, and the digital-analog converter DAC described above with reference to FIG. 3. The shift register may sequentially provide frame data (or parallel data) to the data latch. The data latch may latch the data sequentially received from the shift register, and simultaneously, provide the data to the digital-analog converter DAC. The digital-analog converter DAC may convert data in a digital form into a data signal (or data voltage) in an analog form, based on gamma voltages.

In an embodiment, the clock generating circuit 411 of the timing controller 410 provides the recovery timing control signal SFC to the clock recovery circuit 312 of the data driver 310 as described above, but the disclosure is not limited thereto. In one alternative embodiment, for example, the clock recovery circuit 312 may provide the timing controller 410 (or the clock generating circuit 411) with a status signal representing whether the clock recovery circuit 312 has recovered the clock signal.

Figure 5:
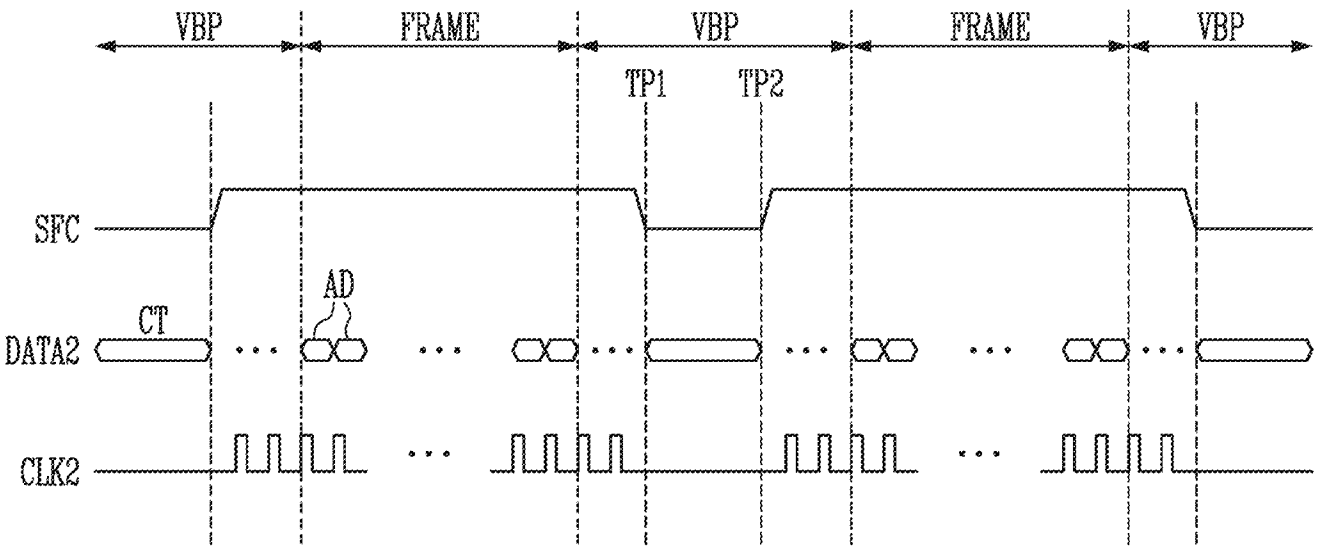
FIG. 5 is a diagram illustrating an embodiment of an operation of the display device shown in FIG. 1 in a first section.

FIG. 5 is a diagram illustrating an embodiment of an operation of the display device shown in FIG. 1 in a first section.

Referring to FIGS. 4 and 5, the first section may include a frame section FRAME and a vertical blank section VBP.

The recovery timing control signal SFC generated in the timing controller 410 may have a logic low level in a portion of the vertical blank section VBP, and have a logic high level in the frame section FRAME.

In one embodiment, for example, the recovery timing control signal SFC may have the logic low level between a first time point TP1 and a second time point TP2 in the vertical blank section VBP.

The data packet DATA2 may include a clock training signal CT (or clock training pattern) between the first time point TP1 and the second time point TP2. That is, the timing controller 410 may insert the clock training signal CT into the data packet DATA2, corresponding to a section in which the recovery timing control signal SFC has the logic low level.

The data driver 310 may recover the second clock signal CLK2, based on the clock training signal CT.

After the second clock signal CLK2 is normally recovered, the data packet DATA2 in the frame section FRAME may include valid data AD (i.e., frame data).

The data driver 310 may sample the valid data AD from the data packet DATA2, based on the second clock signal CLK2, and recover the frame data. Also, the data driver 310 may generate a data signal, based on the frame data, and provide the data signal to the pixel PXL through the data line DL (see FIG. 1). The pixel PXL may emit light with a luminance corresponding to the data signal.

As described with reference to FIG. 5, in the first section (i.e., in the display section in which an image is displayed on the display panel 100, which is described with reference to FIG. 1), the data driver 310 may recover the second clock signal CLK2 in a unit of a frame. In one embodiment, for example, the data driver 310 may recover the second clock signal CLK2 with a section of $1/60$s, $1/20$s, or $1/240$s.

Figure 6:
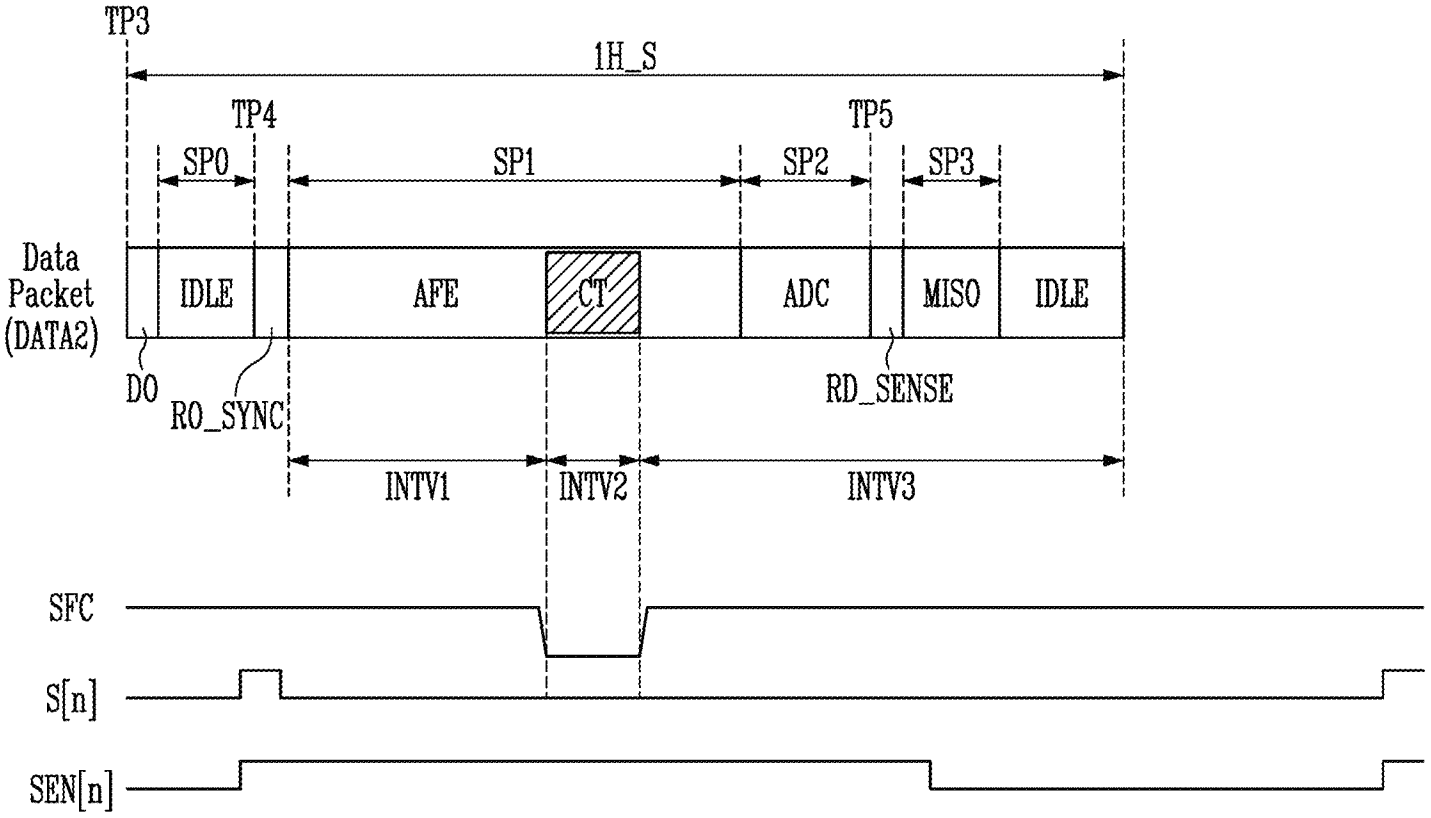
FIG. 6 is a diagram illustrating an embodiment of an operation of the display device shown in FIG. 1 in a second section.

FIG. 6 is a diagram illustrating an embodiment of an operation of the display device shown in FIG. 1 in a second section.

Referring to FIGS. 3, 4, 5, and 6, the second section may include a sensing horizontal section 1H_S (or horizontal section). In one embodiment, for example, the sensing horizontal section 1H_S may be about 635 μs. During the sensing horizontal section 1H_S, the data driver 310 may receive a sensing signal from a pixel PXL included in one pixel row. In one embodiment, for example, when the second section includes a plurality of horizontal sections, the data driver 310 may sequentially receive sensing signals from pixels included in a plurality pixel rows.

At a third time point TP3 (i.e., at a start time of the sensing horizontal section 1H_S), the data packet DATA2 may include a start control signal DO. The data driver 310 may provide a reference voltage (e.g., a voltage for detecting a characteristic of the first transistor T1 (see FIG. 3)) to the k-th data line DLk (see FIG. 3) in response to the start control signal DO.

When the scan signal S[n] has a logic high level (or turn-on voltage level), the second transistor T2 may be turned on, and the reference voltage may be provided to the gate electrode of the first transistor T1.

At the same time, the sensing control signal SEN[n] may have a logic high level, the third transistor T3 may be turned on, and the data driver 310 may be ready for receiving the sensing signal from the pixel PXL.

At a fourth time point TP4, the data packet DATA2 may include a first control signal RO_SYNC. The first control signal RO_SYNC may define or control start of a sensing operation of the data driver 310. In one embodiment, for example, the fourth time point TP4 may be a time which elapses by a reference sub-section SP0 from a time at which the start control signal DO is generated. In one embodiment, for example, the reference sub-section SP0 may be about 50 μs.

The data driver 310 may receive the sensing signal from the pixel PXL in response to the first control signal RO_SYNC.

In an embodiment, the sensing horizontal section 1H_S may include a first sub-section SP1, a second sub-section SP2, and a third sub-section SP3, after the fourth time point TP4. The data driver 310 may recover a clock signal in at least one sub-section among the first sub-section SP1, the second sub-section SP2, and the sub-third section SP3.

In the first sub-section SP1, the data driver 310 may sample the sensing signal from the pixel PXL. The first sub-section SP1 may be an analog front end ("AFE") section in which a voltage is accumulated at a front end of the sensing unit SU described with reference to FIG. 3. In the first sub-section SP1, the sensing signal of the pixel PXL may be stored in the sensing capacitor CSEN described with reference to FIG. 3, and the sampling switch SW_SPL may be turned on, so that the sensing signal is sampled in the first capacitor C1. In one embodiment, for example, the first sub-section SP1 may be about 236 μs.

In an embodiment, the sensing control signal SEN[n] may have a logic high level in the first sub-section SP1 to allow the data driver 310 to receive the sensing signal through the k-th sensing line RLK.

In an embodiment, in the first sub-section SP1, the data driver 310 may recover the clock signal from the data packet DATA2.

In one embodiment, for example, in the first sub-section SP1, the data packet DATA2 may include a clock training signal CT, and the recovery timing control signal SFC may have a logic low level. The data driver 310 may recover the clock signal, based on the clock training signal CT, in response to the recovery timing control signal SFC. In one embodiment, for example, the data driver 310 may start recovering the clock signal after a first interval INTV1 from the start time of the first sub-section SP1, and recover the clock signal during a second interval INTV2. In one embodiment, for example, the first interval INTV1 may be about 130 μs, and the second interval may be about 64 μs. The section in which the clock signal is recovered in the data driver 310 may be located before a third interval INTV3 from an end time of the sensing horizontal section 1H_S. In one embodiment, for example, the third interval INTV3 may be about 260 μs.

While the clock signal is being recovered in the data driver 310 (or the clock recovery circuit 312), a high-frequency noise may occur. When the clock signal is recovered at the same time when the sensing signal is receive, the high-frequency noise may have influence on the sensing signal. However, as will be described later with reference to FIG. 10, a noise of the sensing signal, which is caused by the high-frequency noise, may be constantly represented and be predictable. Thus, the data driver 310 may effectively remove a predicted noise component from the sensing signal (i.e., the sensing to signal is compensated), so that the reliability of the sensing signal may be ensured.

In an embodiment, in the first sub-section SP1, the sensing control signal SEN[n] may have a logic high level, and the second transistor T2 may maintain a turn-on state. That is, the data driver 310 may recover the clock signal while the second transistor T2 is being turned on.

In the second sub-section SP2, the data driver 310 may convert the sampled sensing signal from an analog form to a digital form. The second sub-section SP2 may be an analog-digital converting section in which the voltage is converted into a data value (e.g., a 12-bit digital code) in the analog-digital converter ADC described with reference to FIG. 3. In one embodiment, for example, the second sub-section SP2 may be about 128 μs.

In an embodiment, in the second sub-section SP2, the data driver 310 may not recover the clock signal. The high-frequency noise occurring in the process of recovering the clock signal, which is described above, may have influence on an operation of the analog-digital converter ADC, and an irregular noise may occur. That is, when the clock signal is recovered in the second sub-section SP2, a noise occurring in the analog-digital converter ADC may not be effectively removed or compensated to ensure the reliability of the sensing signal. Therefore, the data driver 310 does not recover the clock signal in the second sub-section SP2.

At a fifth time point TP5 (i.e., at an end time of the second sub-section SP2), the data packet DATA2 may include a second control signal RD_SENSE. The second control signal RD_SENSE may control output of the sensing signal in the data driver 310.

In the third sub-section SP3, the data driver 310 may transmit the sensing signal converted in the digital form (e.g., a digital code) to the timing controller 410 in response to the second control signal RD_SENSE. That is, the third sub-section SP3 may be a master-in-slave-out ("MISO") section in which the converted sensing signal of the data driver 310 is transmitted to the timing controller 410. In one embodiment, for example, the third sub-section SP3 may be about 75 μs.

An idle section IDLE allocated adjacent to the end time of the sensing horizontal section 1H_S may be a margin of the sensing horizontal section 1H_S. In one embodiment, for example, the idle section IDLE may be about 50 μs.

In an embodiment, the data driver 310 may sequentially receive (or sense) sensing signals from the pixels (or pixel rows) by using the sensing horizontal section 1H_S (e.g., about 635 μs) as a section. In such an embodiment, the data driver 310 may repeatedly recover the clock signal by using the sensing horizontal section 1H_S as the section.

In an embodiment, as described with reference to FIG. 6, the data driver 310 may recover the clock signal while sampling (or receiving) the sensing signal from the pixel PXL in the second section (or the sensing horizontal section 1H_S). Thus, no separate time for recovering the clock signal in the sensing horizontal section 1H_S is allocated, such that an increase in the sensing horizontal section 1H_S may be prevented.

The high-frequency noise occurring in the process of recovering the clock signal may have influence on the sensing signal. However, a noise of the sensing signal, which is caused by the high-frequency noise, is constant and predictable. Thus, the data driver 310 (or the timing controller 410) may remove the predicted noise from the sensing signal or compensate for the sensing signal. Accordingly, the reliability of the sensing signal may be ensured.

In an embodiment, the data packet DATA2 (or clock embedded data) may include the clock training signal CT between the first control signal RO_SYNC and the second control signal RD_SENSE in one sensing horizontal section 1H_S to allow the data driver 310 to recover the clock signal in the second section.

Figure 7A:
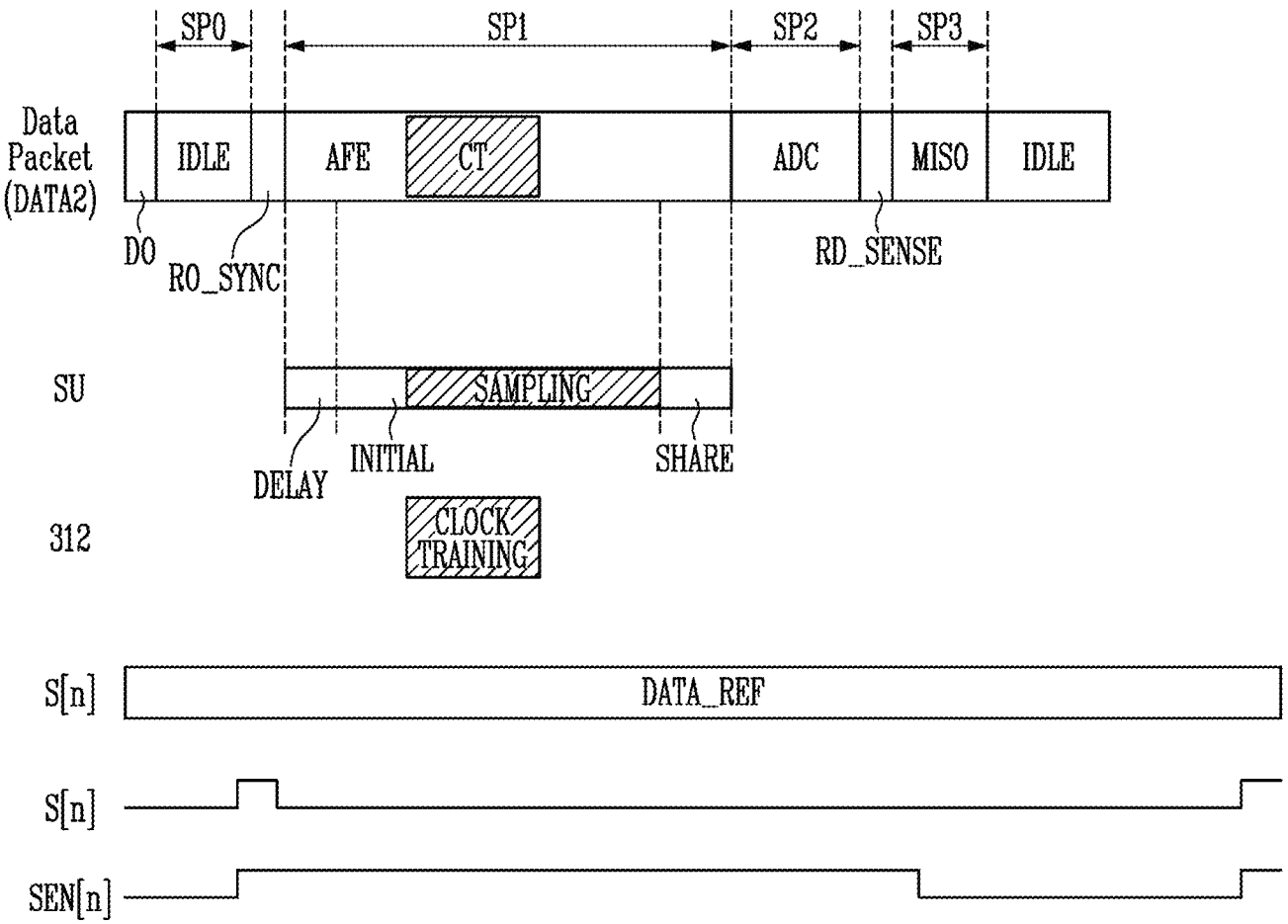
FIGS. 7A and 7B are diagrams illustrating embodiments of an operation of the data driver shown in FIG. 3 in the second section.
Figure 7B:
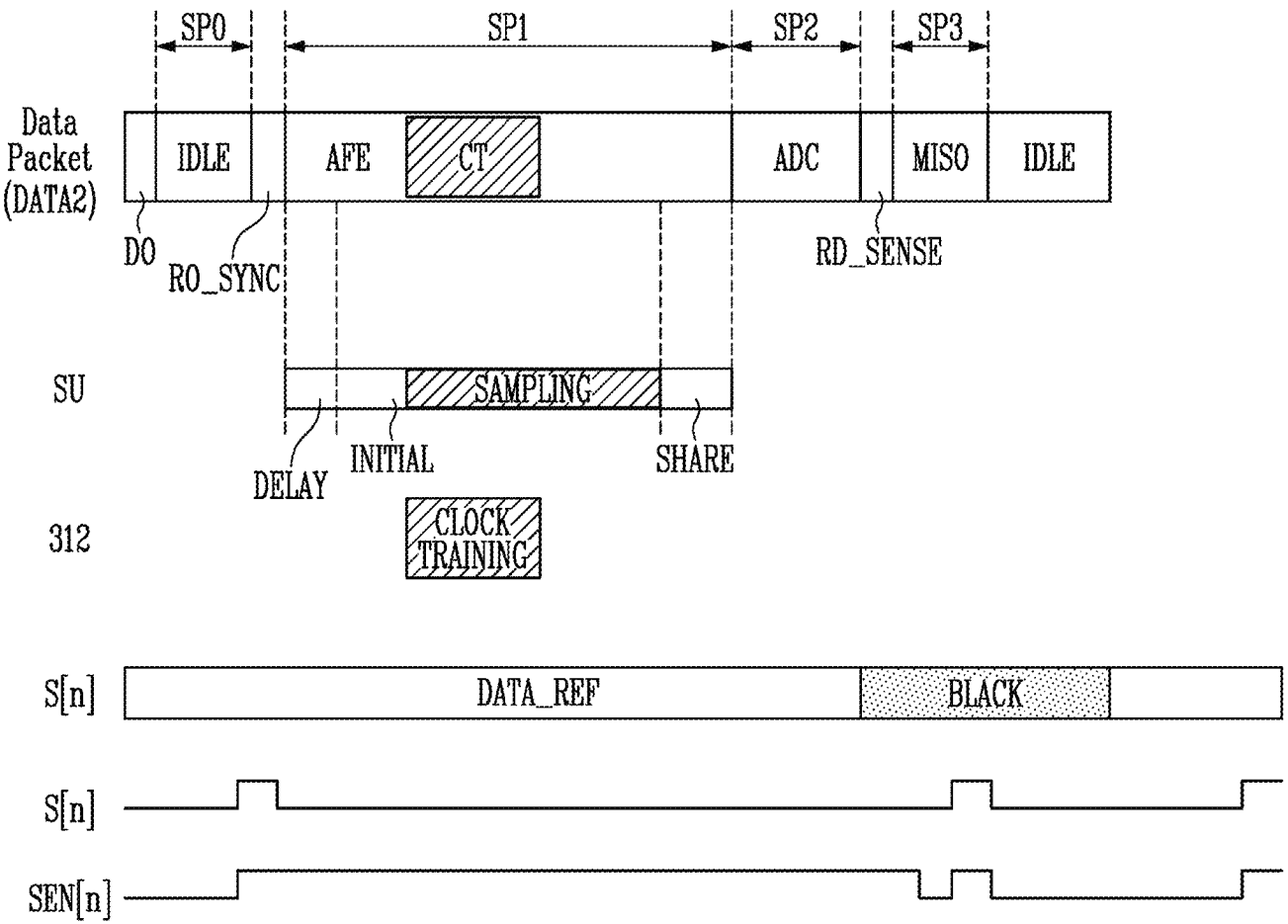

FIGS. 7A and 7B are diagrams illustrating embodiments of an operation of the data driver shown in FIG. 3 in the second section.

First, referring to FIGS. 3, 6, and 7A, an operation of the data driver 310 is substantially the same as or similar to that of the data driver 310, which is described with reference to FIG. 6, except the first sub-section SP1, and therefore, any repetitive detailed description thereof will be omitted.

In the second section, the data voltage DATA provided to the k-th data line DLk from the data driver 310 may have a reference voltage DATA_REF. In one embodiment, for example, the data driver 310 may provide the reference voltage DATA_REF to the k-th data line DLk in the first to third sub-sections SP1, SP2, and SP3.

The first sub-section SP1 may sequentially include a delay section DELAY, an initialization section INITIAL, a sampling section SAMPLING, and a sharing section SHARE.

The delay section DELAY may correspond to a delay time until before the sensing unit SU performs a sensing operation, after the data driver 310 receives the first control signal RO_SYNC. In one embodiment, for example, the delay section DELAY may be about 4 μs.

In the initialization section INITIAL, the initialization switch SW_VINIT of the sensing unit SU may be turned on, and the initialization voltage VINIT may be applied to the kth sensing line RLk. The third transistor T3 is in a state in which the third transistor T3 is turned on by the sensing control signal SEN[n] having a logic high level (or turn-on voltage level), and therefore, the initialization voltage VINIT may be applied to the second node N2.

The initialization section INITIAL may be about 16 μs.

In the sampling section SAMPLING, characteristic information of the pixel PXL (or the first transistor T1) may be stored in the sensing capacitor CSEN of the sensing unit SU, and the sampling switch SW_SPL may be turned on, so that the characteristic information of the pixel PXL is sampled in the first capacitor C1. In one embodiment, for example, the sampling section SAMPLING may be about 200 μs.

In an embodiment, the clock recovery circuit 312 of the data driver 310 may perform a clock training operation of recovering a clock signal, based on the clock training signal CT of the data packet DATA2 (or clock embedded data).

In one embodiment, for example, the clock recovery circuit 312 may perform the clock training operation at the same time when the sampling section SAMPLING is started. In one embodiment, for example, while the sampling switch SW_SPL of the sensing unit SU is being turned on, the clock recovery circuit 312 may recover the clock signal. In one embodiment, for example, the sampling switch SW_SPL of the sensing unit SU is turned on only during the sampling section SAMPLING of the one sensing horizontal section 1H_S described with reference to FIG. 6, and therefore, the clock recovery circuit 312 (or the data driver 310) may perform a one-time clock training operation for every section in which the sampling switch SW_SPL is turned on.

Subsequently, in the sharing section SHARE, the sharing switch SW_SHARE of the sensing unit SU may be turned on, and the sensing unit SU may provide the sampled characteristic information, i.e., a sensing signal to the analog-digital converter ADC.

In an embodiment, in the third sub-section SP3, the pixel PXL (or the light emitting element LED) may emit light based on a gate-source voltage of the first transistor T1 of the pixel PXL. In such an embodiment, when the second section corresponds to the vertical blank section VBP described with reference to FIG. 5, the pixel PXL may emit light with an unwanted luminance in the vertical blank section VBP.

Therefore, in such an embodiment, the display device 10 (see FIG. 1) may suppress light emission of the pixel PXL by varying the second power voltage VSS (see FIG. 3), e.g., by increasing the voltage level of the second power voltage VSS. However, the disclosure is not limited thereto.

Referring to FIGS. 3 and 7B, in an alternative embodiment, the data driver 310 may provide a black data voltage BLACK to the k-th data line DLk in the third sub-section SP3. The black data voltage BLACK may be a data voltage at which the pixel does not emit light. In one embodiment, for example, the black data voltage BLACK may be a data voltage corresponding to grayscale of 0 or a black grayscale.

In such an embodiment, the scan signal S[n] may have a logic high level in the third sub-section SP3. The second transistor T2 may be turned on, and the black data voltage may be provided to the gate electrode of the first transistor T1.

In the third sub-section SP3 (i.e., a section in which the scan signal S[n] has the logic high level), the sensing control signal SEN[n] may have a logic high level. The third transistor T3 may be turned on, and the initialization voltage VINIT may be applied to the second node N2. Therefore, in the third sub-section SP3, the pixel PXL may display black, corresponding to the black data voltage, or may not emit light.

In an embodiment, as described with reference to FIGS. 7A and 7B, the data driver 310 (or the clock recovery circuit 312) may recover the clock signal in the sampling section SAMPLING (i.e., a section in which the sensing unit SU performs a sampling operation of the sensing signal and a section in which the sampling switch SW_SPL of the sensing unit SU is turned on).

Figure 8:
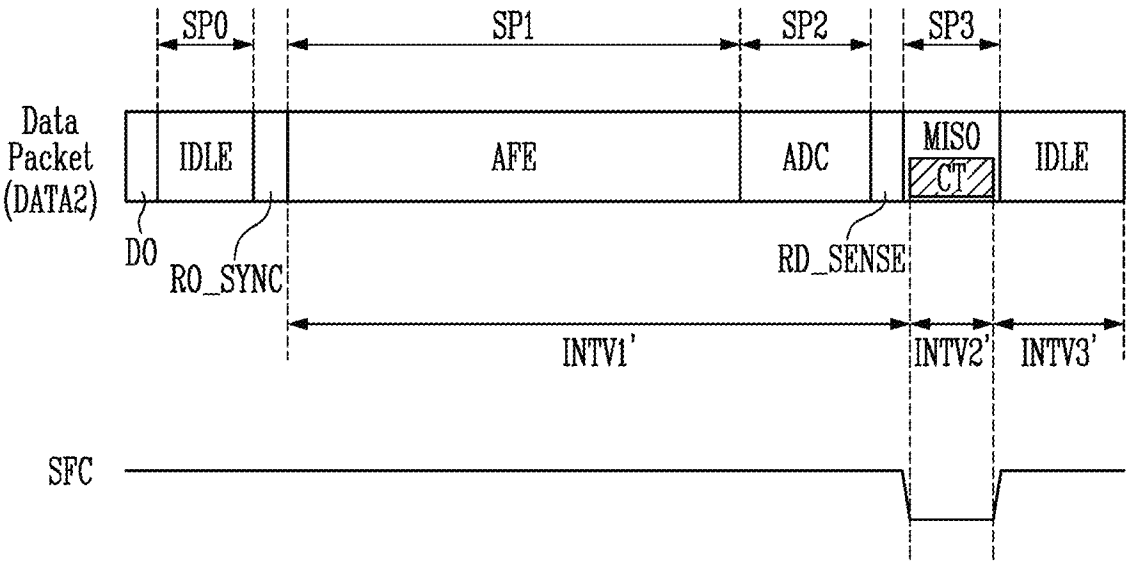
FIG. 8 is a diagram illustrating an alternative embodiment of the operation of the display device shown in FIG. 1 in the second section.

FIG. 8 is a diagram illustrating an alternative embodiment of the operation of the display device shown in FIG. 1 in the second section.

Referring to FIGS. 3, 6, and 8, an operation of the data driver 310 (or the display device 10 (see FIG. 1)) is substantially the same as or similar to that of the data driver 310, which is described with reference to FIG. 6, except that the data driver 310 recovers a clock signal in the third sub-section SP3 instead of the first sub-section SP1, and therefore, any repetitive detailed discerption of the same or like features thereof will be omitted or simplified.

In an embodiment, as shown in FIG. 8, in the third sub-section SP3, the data driver 310 may recover the clock signal from the data packet DATA2.

In one embodiment, for example, in the third sub-section SP3, the data packet DATA2 may include a clock training signal CT, and the recovery timing control signal SFC may have a logic low level. The data driver 310 may recover the clock signal, based on the clock training signal CT, in response to the recover timing control signal SFC. In one embodiment, for example, the data driver 310 may start recovering the clock signal after a first interval INTV1' from a time at which the first control signal RO_SYNC is received, and recover the clock signal during a second interval INTV2'. In one embodiment, for example, the first interval INTV1' may be about 340 μs, and the second interval INTV2' may be about 54 μs. The section in which the clock signal is recovered in the data driver 310 may be located before a third interval INTV3' from an end time of the sensing horizontal section 1H_S. In one embodiment, for example, the third interval INTV3' may be about 93.5 μs.

In an embodiment where the timing controller 410 and the data driver 310 are coupled to each other in a point-to-point ("P2P") manner instead of a multi-drop manner (i.e., a structure in which a plurality of data drivers are coupled to one line), the data driver 310 may recover the clock signal in the third sub-section SP3.

When the timing controller 410 and the data driver 310 are coupled to each other in the multi-drop manner, a command for recovering the clock signal may be properly transferred to the data drivers. Therefore, as described with reference to FIG. 6, the data driver 310 may recover the clock signal in the first sub-section SP1.

In an embodiment, as described with reference to FIG. 8, in the second section, the data driver 310 recovers the clock signal at the same time when the data driver 310 transmits a sensing signal (or a data code corresponding to the sensing signal) to the timing controller 410. Thus, no separate time for recovering the clock signal in the second section is allocated, such that an increase in the second section (i.e., the sensing time) may be prevented.

Figure 9:
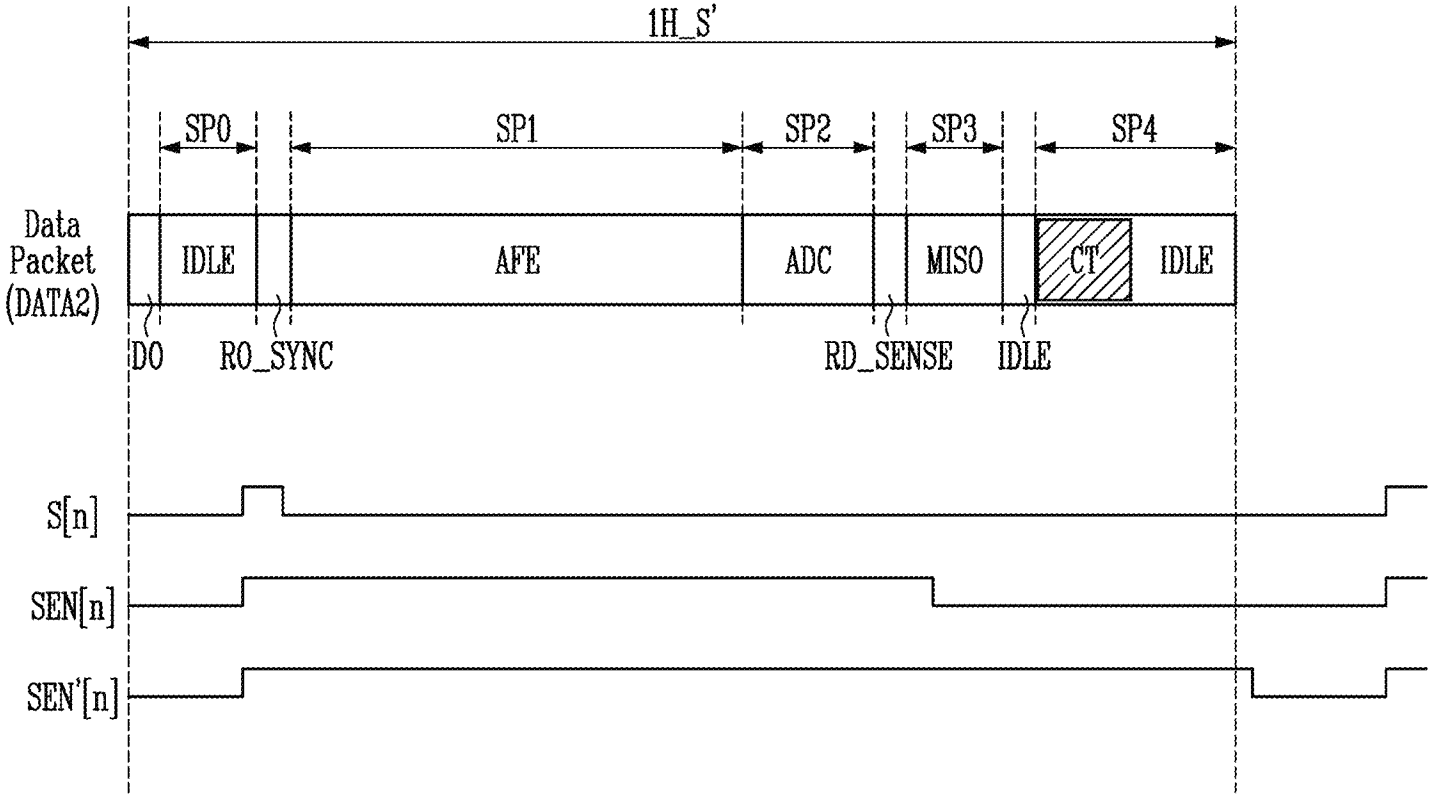
FIG. 9 is a diagram illustrating a comparative example of the operation of the display device shown in FIG. 1 in the second section.

FIG. 9 is a diagram illustrating a comparative example of the operation of the display device shown in FIG. 1 in the second section.

Referring to FIGS. 6 and 9, in a comparative example, the second section may include a sensing horizontal section 1H_S', and the sensing horizontal section 1H_S' may further include a fourth sub-section SP4 after the third sub-section SP3.

The data driver 310 may recover a clock signal in the fourth sub-section SP4.

In the comparative example, as shown in FIG. 9, in the fourth sub-section SP4, the data packet DATA2 may include a clock training signal CT, and the data driver 310 may recover the clock signal, based on the clock training signal CT.

However, since the sensing horizontal section 1H_S' includes the fourth sub-section SP4, a time for which a sensing signal is received from the pixel PXL may be increased.

In particular, when the fourth sub-section SP is included for every sensing horizontal section 1H_S', an increment of a total sensing time for which sensing signals are sequentially received from pixels may be further increased.

In the comparative example, only a sensing horizontal section 1H_S' of a specific pixel row may include the fourth sub-section SP4 to reduce the increase in the total sensing time. However, a noise may occur in a sensing signal received in the corresponding sensing horizontal section 1H_S'. In a case based on 16 pixel rows, a sensing horizontal section 1H_S' of first to fifteenth pixel rows does not include the fourth sub-section SP4, and only a sensing horizontal section 1H_S' of a sixteenth (or thirty-second, forty-eighth, and the like) pixel row may include the fourth sub-section SP4. In an actual measurement result of sensing signals, it was checked that a noise has occurred in a sensing signal of the sixteenth (or thirty-second, forty-eighth, and the like) pixel row.

Figure 10:
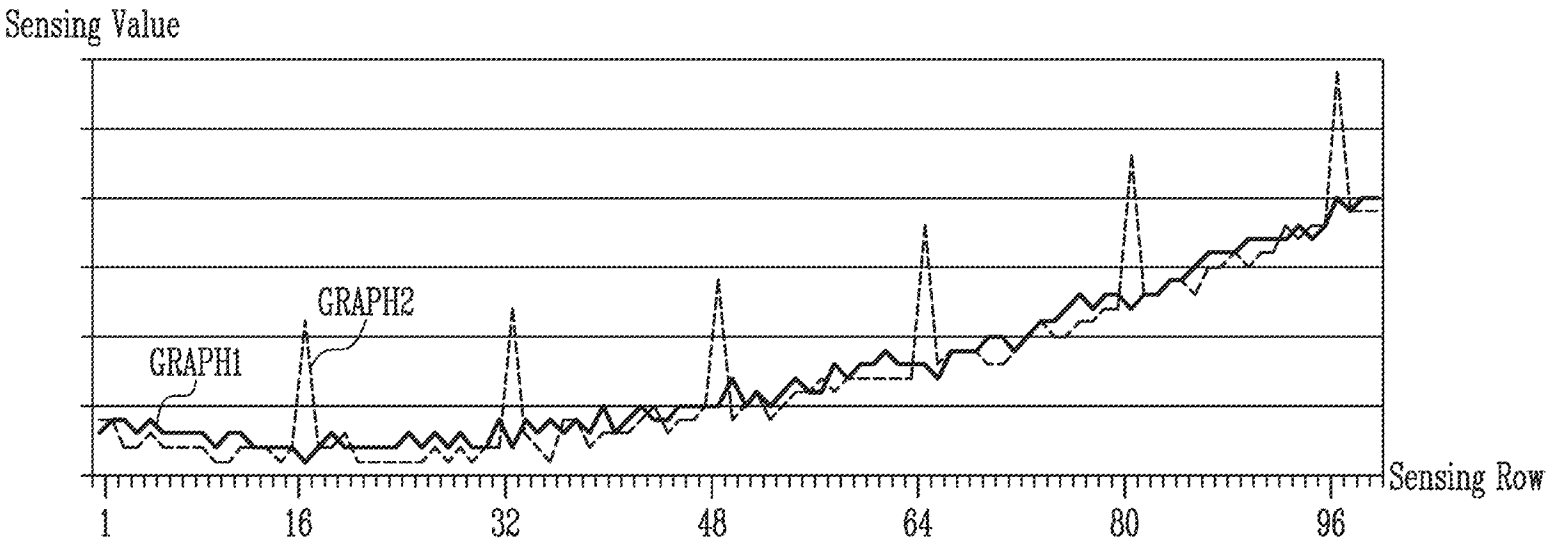
FIG. 10 is a diagram illustrating a sensing signal generated in the display device shown in FIG. 1 operated according to an embodiment of the invention and the comparative example.

FIG. 10 is a diagram illustrating a sensing signal generated in the display device shown in FIG. 1 operated according to an embodiment of the invention and the comparative example.

Referring to FIG. 10, a first graph GRAPH1 (or first curve) represents first sensing signals acquired through an embodiment of the operations of the display device, which are shown in FIGS. 6 to 8, and a second graph GRAPH2 (or second curve) represents second sensing signals acquired through the comparative example of the operation of the display device, which are shown in FIG. 9. A sensing row may represent a pixel row (or a pixel included therein) on which the data driver 310 receives a sensing signal, and a sensing value may represent a sensing signal (i.e., a data code).

Referring to the second graph GRAPH2, in a case where the data driver 310 recovers a clock signal for every sixteen pixel rows, a noise in an impulse form occurs in a corresponding pixel row (e.g., a sixteenth row, a thirty-second row, a forty-eighth row, or the like). When the second sensing signals are expressed with a 12-bit data code, the magnitude of the corresponding noise may be about 5.

The data driver 310 may perform a compensation operation of removing the corresponding noise from the second sensing signals according to the second graph GRAPH2. However, the compensation operation is relatively complicated, and an increase in the sensing horizontal section 1H_S' (and the sensing time) is not prevented.

In an embodiment of the invention, referring to the first graph GRAPH1, when the data driver 310 recovers the clock signal while receiving the sensing signal, the first sensing signals may include a noise entirely uniform on sensing row (i.e., pixel rows), as compared with the second sensing signals. In one embodiment, for example, when the first sensing signals are exposed with a 12-bit data code, the magnitude of the corresponding noise may be about 1.

The data driver 310 may compensate for the first sensing signals through only an operation of subtracting an entirely predicted noise (e.g., a value of 1) from the first sensing signals according to the first graph GRAPH1. That is, through a simpler compensation operation, the data driver 310 may ensure the reliability of the first sensing signals. Further, as described with reference to FIGS. 6 to 8, no separate time for recovering the clock signal is allocated to the sensing horizontal section 1H_S, such that an increase in the sensing horizontal section 1H_S (and the sensing time) may be prevented.

Figure 11:
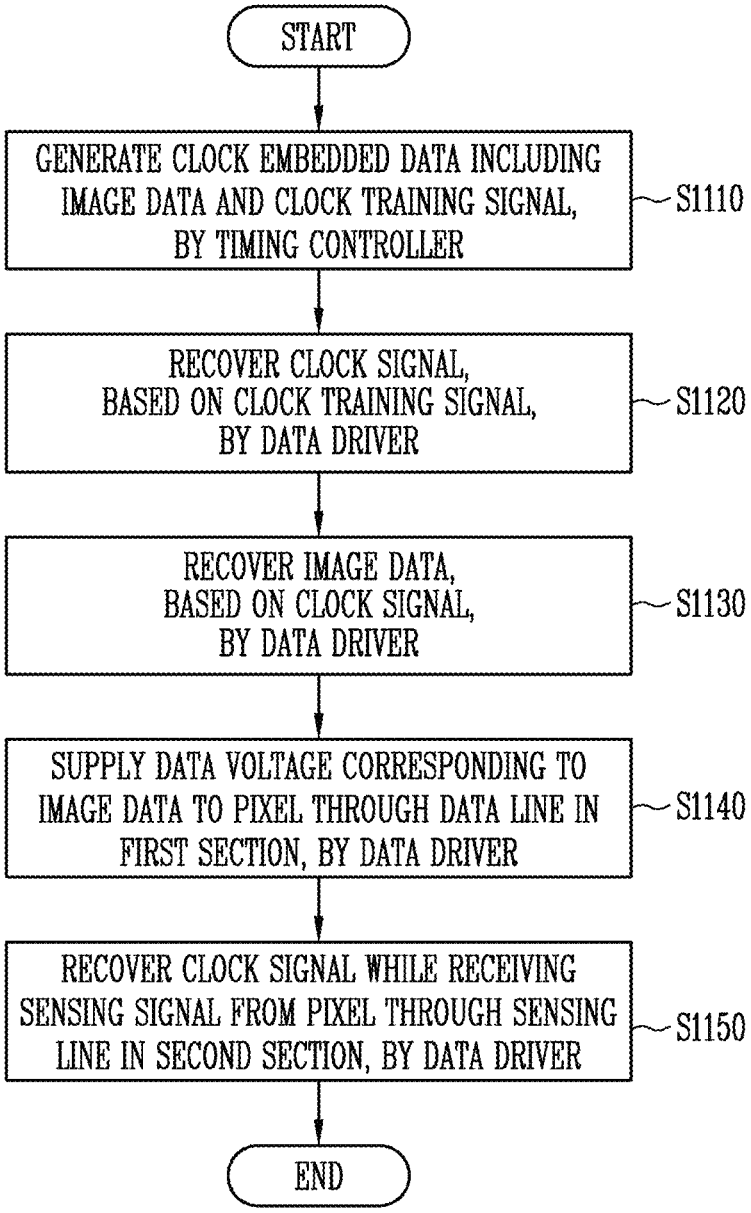
FIG. 11 is a diagram illustrating a driving method of the display device in accordance with an embodiment of the disclosure.

FIG. 11 is a diagram illustrating a driving method of the display device in accordance with an embodiment of the disclosure.

Referring to FIGS. 1, 5, and 6, the driving method shown in FIG. 11 may be performed in the display device 10 shown in FIG. 1.

In an embodiment of the driving method shown in FIG. 11, clock embedded data (or a data packet) including image data and a clock training signal may be generated by the timing controller 410 (S1110).

In an embodiment, as shown in FIG. 5, the timing controller 410 may generate the clock embedded data by inserting the clock training signal between frame data in a first section (or display section).

In an alternative embodiment, as shown in FIG. 6, the timing controller 410 may generate the clock embedded data by inserting the clock training signal in the first sub-section SP1 in which the data driver 310 sensing characteristic information of the pixel PXL in a second section (or sensing section).

In an embodiment of the driving method shown in FIG. 11, a clock signal may be recovered based on the clock training signal of the clock embedded data by the data driver 310 (S1120).

In an embodiment, as described with reference to FIGS. 5 and 6, when the recovery timing control signal SFC has a logic low level, the data driver 310 (or the clock recovery circuit 312 (see FIG. 4)) may recover the clock signal, based on the clock training signal of the clock embedded data.

In an embodiment of the driving method shown in FIG. 11, image data (or frame data) may be recovered from the clock embedded data, based on the clock signal, by the data driver 310 (S1130). In one embodiment, for example, in the driving method shown in FIG. 11, the image data may be recovered by sampling each of bits of the image data in the clock embedded data, based on the second clock signal CLK2.

In an embodiment of the driving method shown in FIG. 11, a data voltage corresponding to the image data may be supplied to the data line DL by the data driver 310 in the first section (or display section) (S1140). The pixel PXL may emit light with a luminance corresponding to the data voltage.

In an embodiment of the driving method shown in FIG. 11, at least one sensing signal may be received from at least one of the pixels through the sensing line RL in the second section (or sensing section) different from the first section.

In one embodiment, for example, the second section may be a vertical blank section (or vertical porch section) between frame sections. In an embodiment of the driving method shown in FIG. 11, a sensing signal (e.g., a mobility of the driving transistor or a signal related thereto) may be received from the pixel PXL. In an alternative embodiment, the second section may be a section immediately before the display device 10 is power-off. In an embodiment of the driving method shown in FIG. 11, sensing signals (e.g., a threshold voltage of the driving transistor of each of pixels including the pixel PXL) may be sequentially received from the pixels.

In an embodiment, in the driving method shown in FIG. 11, the clock signal may be recovered by the data driver 310, while at least one sensing signal is being received by the data driver 310 (S1150).

As described with reference to FIGS. 6 to 8, in an embodiment of the driving method shown in FIG. 11, the clock signal may be recovered in one of the first to third sub-sections SP1, SP2, and SP3 of the sensing horizontal section 1H_S included in the second section. In one embodiment, for example, in the driving method shown in FIG. 11, the clock signal may be recovered in the first sub-section SP1. As described with reference to FIG. 7A, the clock signal may be recovered while a sensing signal is sampled by the data driver 310 (i.e., during a sampling section). In an alternative embodiment, the clock signal may be recovered in the third sub-section.

In an embodiment of the driving method shown in FIG. 11, when sensing signals are sequentially received (or sensed) in the unit of the pixel row by the data driver 310, the clock signal may be recovered whenever each of the sensing signals is received. In such an embodiment, the clock signal may be repeatedly recovered in the unit of the pixel row.

In an embodiment, as described with reference to FIG. 11, in the driving method, the clock signal may be recovered at the same time when the sensing signal is received (or sampled) from the pixel PX through the data driver 310 in the second section (or the sensing section, or the sensing horizontal section 1H_S). Thus, no separate time for recovering the clock signal is allocated to the sensing horizontal section 1H_S (and the sensing section), such that an increase in the sensing horizontal section 1H_S (and the sensing section) may be prevented.

In embodiments of the display panel driving device, the display device, and the driving method thereof, a clock signal may be recovered from clock embedded data while a characteristic of the pixel is being sensed by the data driver. Thus, a clock and data may be stably recovered without increasing sensing time.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel including a data line, a sensing line, and pixels coupled to the data line and the sensing line;

a timing controller which generates clock embedded data including image data and a clock training signal; and a data driver which recovers a clock signal, based on the clock training signal of the clock embedded data, recovers the image data of the clock embedded data, based on the clock signal, supplies a data voltage corresponding to the image data to the data line in a first section, and receives a sensing signal from a pixel of the pixels through the sensing line in a second section different from the first section, wherein, in the second section, the data driver recovers the clock signal while the sensing signal is being received.

2. The display device of claim 1, wherein, in the second section, the data driver sequentially receives sensing signals from the pixels, and recovers the clock signal whenever each of the sensing signals is received.

3. The display device of claim 2, wherein the data driver senses each of the sensing signals of the pixels with a first period, and repeatedly recovers the clock signal with the first period.

4. The display device of claim 1, wherein the second section includes a first sub-section, a second sub-section, and a third sub-section, the data driver samples a sensing signal of the pixel of the pixels in the first sub-section, converts the sampled sensing signal from an analog form to a digital form in the second sub-section, and transmits the sensing signal in the digital form to the timing controller in the third sub-section, and the data driver recovers the clock signal in one of the first to third sub-sections.

5. The display device of claim 4, wherein the data driver recovers the clock signal in the first sub-section.

6. The display device of claim 5, wherein the data driver does not recover the clock signal in the second sub-section.

7. The display device of claim 5, wherein in the second section, the clock embedded data sequentially includes a first control signal for controlling start of a sensing operation of the data driver and a second signal for controlling output of the sensing signal of the data driver, wherein the clock embedded data includes the clock training signal between the first control signal and the second control signal.

8. The display device of claim 5, wherein the data driver includes:

a sampling switch including one end coupled to the sensing line;

a capacitor coupled between the other end of the sampling switch and a reference power source to sample the sensing signal; and an analog-digital converter coupled to the other end of the sampling switch, wherein the data driver recovers the clock signal while the sampling switch is being turned on.

9. The display device of claim 8, wherein the data driver performs one-time clock training for every section in which the sampling switch is turned on.

10. The display device of claim 8, wherein the data driver provides a reference voltage to the data line in the first to third sub-sections.

11. The display device of claim 8, wherein, in the third sub-section, the data driver provides a black data voltage at which the pixel does not emit light.

12. The display device of claim 4, wherein the data driver recovers the clock signal in the third sub-section.

13. The display device of claim 1, wherein the display panel further includes a scan line, a sensing control line, a first power line, and a second power line, each of the pixels includes:

a first transistor including a first electrode coupled to the first power line, a second electrode coupled to a second node, and a gate electrode coupled to a first node;

a second transistor including a first electrode coupled to the data line, a second electrode coupled to the first node, and a gate electrode coupled to the scan line;

a third transistor including a first electrode coupled to the second node, a second electrode coupled to the sensing line, and a gate electrode coupled to the sensing control line;

a storage capacitor coupled between the first node and the second node; and a light emitting element coupled between the second node and the second power line, wherein the data driver recovers the clock signal while the second transistor of each of the pixels is being turned on.

14. The display device of claim 1, wherein, in the first section, the data driver recovers the clock signal before or after a portion of clock embedded data corresponding to image data of one frame is received.

15. The display device of claim 1, wherein the timing controller provides a recovery timing control signal to the data driver, and the data driver recovers the clock signal in response to the recovery timing control signal.

16. A display panel driving device for driving a display panel including a data line, a sensing line, and pixels coupled to the data line and the sensing line, the display panel driving device comprising:

to a timing controller which generates clock embedded data including image data and a clock training signal; and a data driver which recovers a clock signal, based on the clock training signal of the clock embedded data, recovers the image data of the clock embedded data, based on the clock signal, supplies a data voltage corresponding to the image data to the data line in a first section, and receives a sensing signal from a pixel of the pixels through the sensing line in a second section different from the first section, wherein, in the second section, the data driver recovers the clock signal while the sensing signal is being received.

17. A method of driving a display device including a display panel including a data line, a sensing line, and pixels coupled to the data line and the sensing line, the method comprising:

generating, by a timing controller of the display device, clock embedded data including image data and a clock training signal;

recovering, by a data driver of the display device, a clock signal, based on the clock training signal of the clock embedded data;

recovering, by the data driver, the image data from the clock embedded data, based on the clock signal;

supplying, by the data driver, a data voltage corresponding to the image data to the data line in a first section; and receiving, by the data driver, a sensing signal from a pixel of the pixels through the sensing line in a second section different from the first section, wherein the receiving the sensing signal includes recovering, by the data driver, the clock signal while the sensing signal is being received.

18. The method of claim 17, wherein, in the second section, the data driver sequentially receives sensing signals from the pixels, and recovers the clock signal whenever each of the sensing signals is received.

19. The method of claim 17, wherein the second section includes a first sub-section, a second sub-section, and a third sub-section, the receiving the sensing signal further includes:

sampling the sensing signal of the pixel of the pixels in the first sub-section;

converting the sampled sensing signal from an analog form to a digital form in the second sub-section; and transmitting the sensing signal in the digital form to the timing controller from the data driver in the third sub-section, and the data driver recovers the clock signal in one of the first to third sub-sections.

20. The method of claim 19, wherein the data driver recovers the clock signal in the first sub-section.

* * * * *